US009091081B2

(12) United States Patent
Yuzuriha

(10) Patent No.: US 9,091,081 B2
(45) Date of Patent: Jul. 28, 2015

(54) EXTERIOR-WALL STRUCTURE

(75) Inventor: Tomohiro Yuzuriha, Iga (JP)

(73) Assignee: KMEW CO., LTD., Osaka-Shi (JP)

( * ) Notice: Subject to any disclaimer, the term of this patent is extended or adjusted under 35 U.S.C. 154(b) by 976 days.

(21) Appl. No.: 12/041,069

(22) Filed: Mar. 3, 2008

(65) Prior Publication Data

US 2009/0056266 A1 Mar. 5, 2009

(30) Foreign Application Priority Data

Aug. 30, 2007 (JP) ..... 2007-224601

(51) Int. Cl.
*E04B 2/72* (2006.01)
*E04F 13/08* (2006.01)
*E04F 13/14* (2006.01)

(52) U.S. Cl.
CPC ..... *E04F 13/0871* (2013.01); *E04F 13/147* (2013.01)

(58) Field of Classification Search
CPC ..... E04F 13/147; E04F 13/0871; B28B 11/0863; B44F 11/06; B27D 1/04
USPC ..... 52/314, 311.1, 506.05, 105, 316, 311.2, 52/555, 558, 605; D25/123, 125, 138
See application file for complete search history.

(56) References Cited

U.S. PATENT DOCUMENTS 1,856,936 A * 5/1932 Turner ..... 156/347
1,973,564 A * 9/1934 Graham ..... 434/96
2,039,536 A * 5/1936 Johnson ..... 52/314
2,114,450 A * 4/1938 MacLean ..... 52/314
2,482,556 A * 9/1949 Petras ..... 52/314
2,497,837 A * 2/1950 Nelson ..... 52/181
D180,221 S * 5/1957 Carver ..... D25/123
3,338,730 A * 8/1967 Slade et al. ..... 428/142
3,617,336 A * 11/1971 Gilard et al. ..... 428/156
4,461,443 A * 7/1984 Dauman ..... 248/220.41
D275,705 S * 9/1984 Gabriel ..... D25/125
4,644,719 A * 2/1987 Salazar ..... 52/384
4,722,158 A * 2/1988 Urdaneta ..... 52/316
5,032,003 A * 7/1991 Antes ..... 359/567
D330,435 S * 10/1992 Dukart et al. ..... D25/138
D354,358 S * 1/1995 Wells ..... D25/58
D372,107 S * 7/1996 Dunlap et al. ..... D25/113
5,843,546 A * 12/1998 Eichhorn ..... 428/38
5,987,831 A * 11/1999 Lamberts-Van Assche .... 52/316

(Continued)

FOREIGN PATENT DOCUMENTS

JP 50-31236 B 10/1975
JP 6-264586 9/1994

(Continued)

OTHER PUBLICATIONS

English language Abstract of JP 6-264586 retrieved from JPO on or about Feb. 26, 2008 (6 pages).

*Primary Examiner* — Rodney Mintz
(74) *Attorney, Agent, or Firm* — Greenblum & Bernstein, P.L.C.

(57) ABSTRACT

The exterior-wall structure comprises two or more kinds of exterior panels. The two or more kinds of exterior panels have the same outline shape, the same dimensions, and the same surface texture, and, the two or more kinds of exterior panels have respectively a different number, including zero, of grooves on each surface. Each groove runs an entire length of each exterior panel continuously in a longitudinal direction of the exterior panel. The two or more kinds of exterior panels are arranged side by side to form an exterior-wall surface.

7 Claims, 11 Drawing Sheets

(56) References Cited

U.S. PATENT DOCUMENTS

| | | | | |
|---|---|---|---|---|
| 6,012,255 | A * | 1/2000 | Smid et al. | 52/105 |
| 6,131,355 | A * | 10/2000 | Groh et al. | 52/592.1 |
| 6,233,895 | B1 * | 5/2001 | Evans et al. | 52/518 |
| 6,253,512 | B1 * | 7/2001 | Thompson et al. | 52/311.1 |
| 6,760,978 | B2 * | 7/2004 | Gleeson | 33/563 |
| D519,651 | S * | 4/2006 | Simic | D25/138 |
| D533,284 | S * | 12/2006 | Bledsoe et al. | D25/138 |
| D552,759 | S * | 10/2007 | Murdock | D25/121 |
| D570,502 | S * | 6/2008 | Silvestrin | D25/138 |
| D579,586 | S * | 10/2008 | Mattingly | D25/138 |
| D631,985 | S * | 2/2011 | Waters et al. | D25/138 |
| 7,954,298 | B2 * | 6/2011 | Jilg et al. | 52/745.19 |
| 8,114,503 | B2 * | 2/2012 | Klem, Jr. | 428/195.1 |
| 8,365,491 | B2 * | 2/2013 | Schrunk | 52/390 |
| 8,454,871 | B2 * | 6/2013 | Schrunk | 264/139 |
| 8,590,238 | B1 * | 11/2013 | Polak | 52/314 |
| D696,870 | S * | 1/2014 | Vidal Soler | D5/62 |
| 8,745,950 | B2 * | 6/2014 | Ito et al. | 52/578 |
| 8,869,480 | B2 * | 10/2014 | Klem, Jr. | 52/311.1 |
| 8,943,772 | B2 * | 2/2015 | Schrunk | 52/390 |
| 2002/0174622 | A1 * | 11/2002 | Ouellet et al. | 52/745.06 |
| 2004/0200164 | A1 * | 10/2004 | Schrunk | 52/311.1 |
| 2005/0005550 | A1 * | 1/2005 | Schrunk | 52/385 |
| 2006/0026908 | A1 * | 2/2006 | Gregori et al. | 52/105 |
| 2006/0156668 | A1 * | 7/2006 | Nasvik | 52/516 |
| 2007/0019271 | A1 * | 1/2007 | Schrunk | 359/227 |
| 2009/0047487 | A1 * | 2/2009 | Klem, Jr. | 428/210 |
| 2010/0088989 | A1 * | 4/2010 | Nasvik | 52/309.4 |
| 2011/0023396 | A1 * | 2/2011 | Schwarz et al. | 52/314 |
| 2011/0045250 | A1 * | 2/2011 | De Zen | 428/168 |
| 2012/0113519 | A1 * | 5/2012 | Klem, Jr. | 359/597 |
| 2012/0204511 | A1 * | 8/2012 | Ito et al. | 52/578 |
| 2012/0251780 | A1 * | 10/2012 | Oguri | 428/156 |
| 2012/0324814 | A1 * | 12/2012 | Amend | 52/302.1 |
| 2013/0247494 | A1 * | 9/2013 | Schrunk | 52/390 |
| 2013/0338817 | A1 * | 12/2013 | Schrunk | 700/186 |
| 2014/0150355 | A1 * | 6/2014 | Almeida Martins et al. | 52/105 |
| 2014/0202109 | A1 * | 7/2014 | Michalski et al. | 52/588.1 |

FOREIGN PATENT DOCUMENTS

| | | |
|---|---|---|
| JP | 07-091018 | 4/1995 |
| JP | 08-006435 | 1/1996 |
| JP | 11-336297 A | 12/1999 |

* cited by examiner

EXTERIOR-WALL STRUCTURE

TECHNICAL FIELD

The present invention relates to an exterior-wall structure which is formed by arranging and fixing exterior panels (facing panels) having a groove.

BACKGROUND ART

In order to form an exterior wall of a house, a method in which exterior panels made of a ceramic material, such as cement, are arranged and fixed has been widely used. On a surface of such an exterior panel, a surface pattern is formed to look like many materials, such as a stone, a brick, a tile, and so on. And, in order to form an outward appearance of a house according to the surface pattern of the exterior panel, the exterior panels having the same surface pattern of one kind are arranged on the wall, or the exterior panels having different surface patterns of two or more kinds are combined and arranged on the wall. For example, by using an exterior panel having a concave groove running an entire length of the panel in the longitudinal direction of the exterior panel, it is possible to form an exterior-wall surface in which concave grooves are disposed in a stripe state (see, Japanese Patent Application Laid-Open No. 6-264586).

However, when the exterior panels having the same surface pattern of one kind are arranged on the wall, the same surface pattern is repeated on the whole wall surface, whereby the outward appearance of the exterior wall becomes monotonous. And, when the exterior panels having different surface patterns of two or more kinds are combined and arranged on the wall, it is difficult to give sensation of unity of the outward appearance in the whole exterior wall, and it is likely to become a messy outward appearance.

DISCLOSURE OF THE INVENTION

In view of the above problem, the object of the present invention is to provide an exterior-wall structure capable of forming a wall surface which has a varied outward appearance while keeping sensation of unity of the whole exterior wall.

The exterior-wall structure of the present invention comprises two or more kinds of exterior panels. The two or more kinds of exterior panels have the same outline shape, the same dimensions, and the same surface texture, and the two or more kinds of exterior panels have respectively a different number, including zero, of grooves on each surface. Each groove runs an entire length of each exterior panel continuously in a longitudinal direction of the exterior panel. The two or more kinds of exterior panels are arranged side by side to form an exterior-wall surface.

Because the exterior panels of the present invention has the same outward appearance except the grooves, it is possible to form an outward appearance which is based on the grooves and has sensation of unity on a whole area of the exterior-wall surface by arranging the two or more kinds of exterior panels. Furthermore, because the two or more kinds of exterior panels having respectively a different number of the grooves are combined, the arrangement of the grooves is less likely to become monotonous repetition, and it is possible to form a wall surface which has a varied outward appearance.

Preferably, the two or more kinds of exterior panels have the same surface color.

In this case, it is possible to form an outward appearance having sensation of unity on a whole area of the exterior-wall surface in terms of color.

Preferably, each groove is formed at a position which divides the exterior panel at even intervals in a direction perpendicular to a longitudinal direction of the exterior panel.

In this case, the arrangement of the grooves does not become irregular and messy, and it becomes easy to form an outward appearance with sensation of unity.

Preferably, the grooves are formed so that, when two exterior panels having a different number of the grooves are connected to each other in a longitudinal direction of the exterior panel, all the grooves of one exterior panel having a lower number of the grooves are communicated with the grooves of the other exterior panel having a larger number of the grooves.

In this case, it is possible to make the grooves of the exterior panels having a different number of the grooves communicate with each other as much as possible, whereby it is possible to connect the exterior panels so that they become an outward appearance having continuity. Therefore, it becomes easy to form an outward appearance which is natural and has sensation of unity on the whole surface of the exterior-wall surface.

The two or more kinds of exterior panels may have intersecting grooves which run at predetermined angles with respect to the grooves on their surfaces.

In this case, it is possible to form the exterior-wall surface having a varied outward appearance by the intersecting grooves.

BEST MODE FOR CARRYING OUT THE INVENTION

Figure 1:
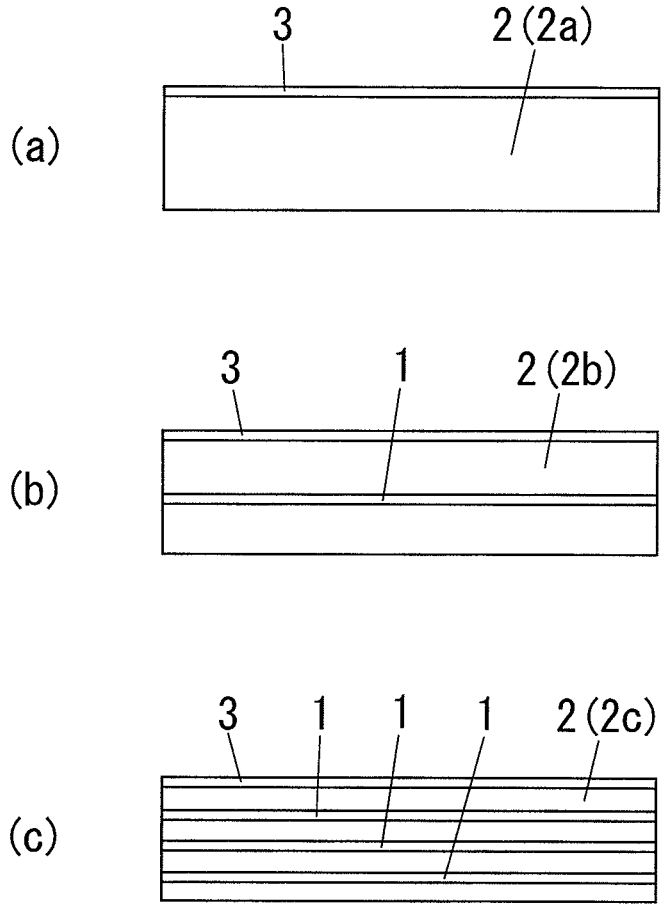
FIG. 1 shows front views of examples of an exterior panel used in an embodiment of the present invention.

Hereinafter, the present invention will be described in more detail with reference to the accompanying drawings.

An exterior panel 2 is manufactured from a ceramic series material, such as cement, a metallic series material, such as a steel plate, or a plastic series material, such as polyvinyl chloride, and is formed into a horizontally-long rectangular shape in this embodiment. Although two or more kinds of the exterior panel 2 are prepared, each kind of the exterior panels 2 is formed to have the same outline shape, the same dimensions, and the same surface texture. Here, the term "to have the same surface texture" means to have the same surface material, the same minute concavity and convexity, the same hand feeling, and so on. That is, each kind of the exterior panels 2 is formed to have the same outward appearance except a concave groove 1 (a recessed groove 1). The above two or more kinds of the exterior panels 2 may be painted the same color to have the same surface color.

In the exterior panels 2, some exterior panels 2 do not have the concave groove 1 on their surfaces, and others have a different number of the concave grooves 1 on the surface. That is, the exterior panels 2 have a different number, including zero, of the concave grooves 1 on the surface. Each concave groove 1 is formed into a straight line form, and runs an entire length of each exterior panels 2 parallel to a longitudinal edge of the exterior panel 2. In each exterior panel 2, the concave grooves 1 are formed to have the same width, and the same depth.

Figure 2B:
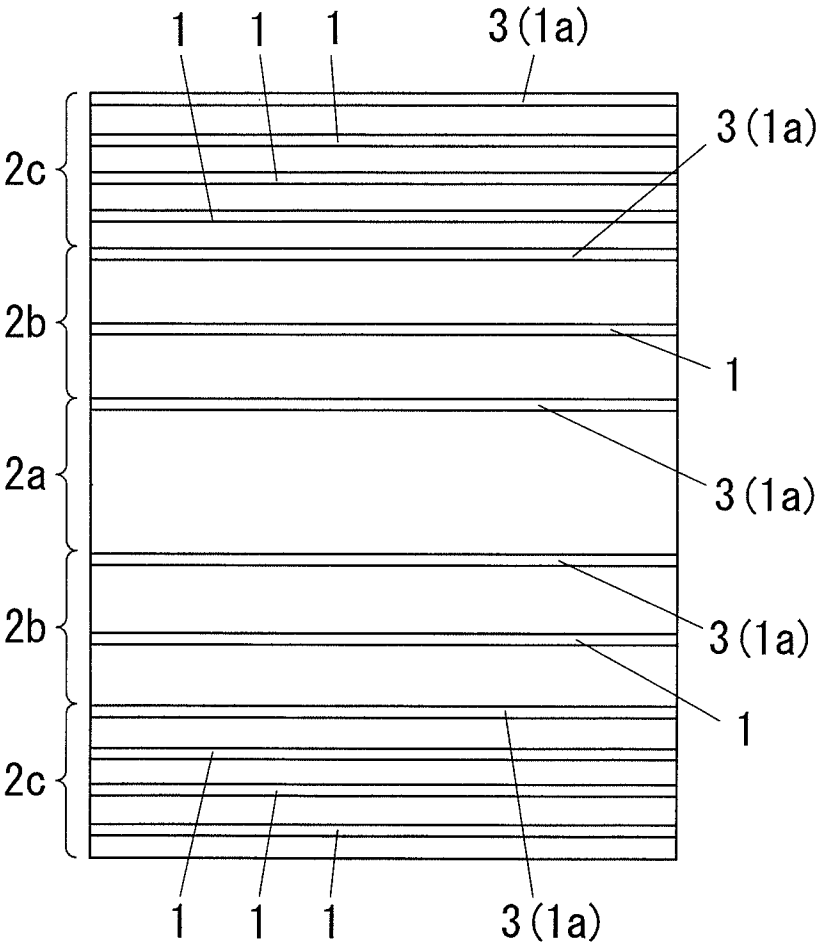
FIGS. 2A and 2B are front views showing examples of an exterior-wall surface formed from the exterior panels of FIG. 1.
Figure 2A:
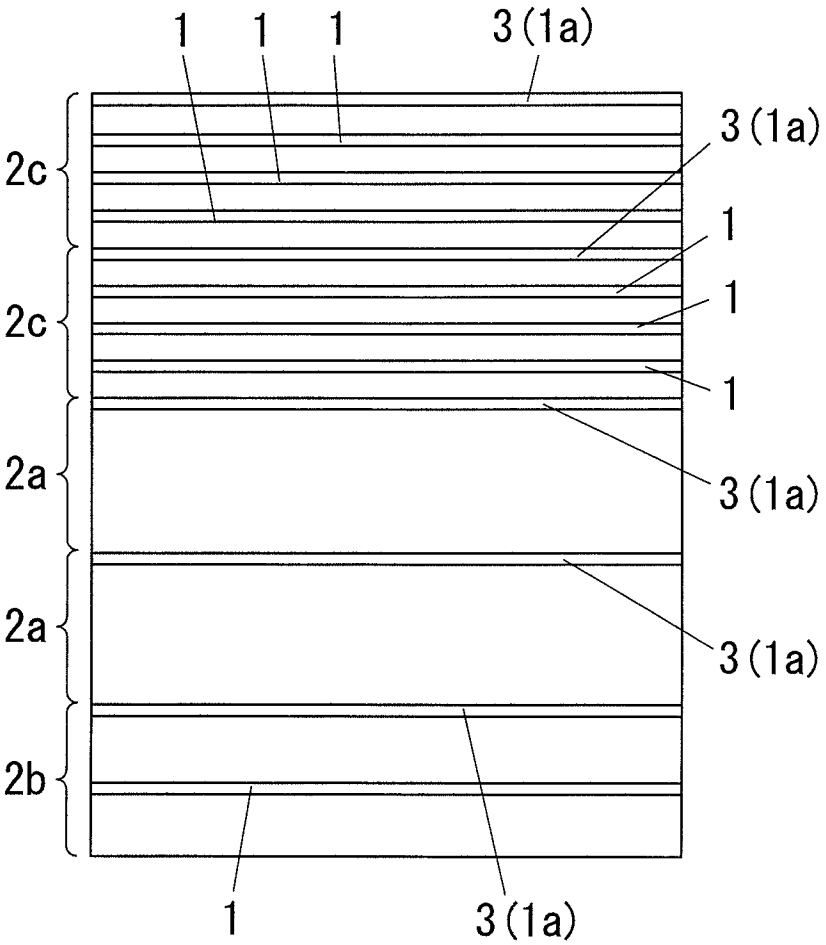
Figure 3:
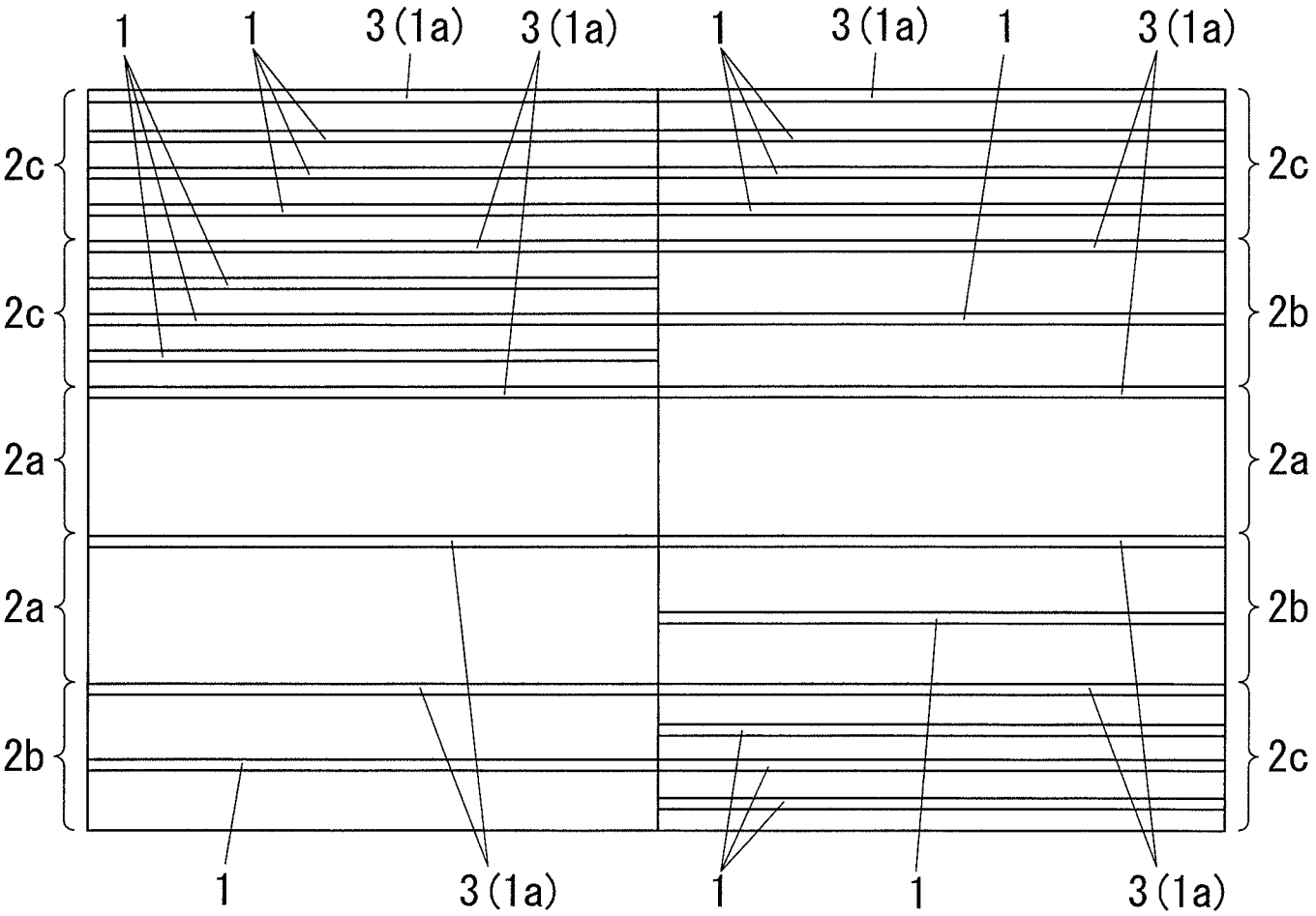
FIG. 3 is a front view showing another example of the exterior-wall surface formed from the exterior panels of FIG. 1.

In a first embodiment of FIGS. 1 to 3, three kinds of the exterior panels 2*a* to 2*c* are used. As shown in FIG. 1, the exterior panel 2*a* does not have the concave groove 1 (that is, the exterior panel 2*a* has zero concave groove), the exterior panel 2*b* has one concave groove 1, and the exterior panel 2*c* has three concave grooves 1. Of course, the number of the concave grooves 1 is not limited to the above numbers, and the number of the concave grooves 1 may be two, four, or more. In each exterior panel 2, a step-like groove 3 is formed linearly over entire length of one longitudinal edge of the exterior panel 2. The width and the depth of the step-like groove 3 are designed so that, when the adjacent exterior panels 2 are connected to each other in a direction perpendicular to the longitudinal direction of the exterior panel 2, a concave groove 1*a* having the same width and the same depth as the concave groove 1 is formed between the adjacent exterior panels 2.

In each exterior panel 2 having the concave groove 1, the concave groove 1 is formed at a position which divides the exterior panel 2 (except the step-like groove 3) at even intervals in a direction perpendicular to the longitudinal direction of the exterior panel 2. For example, when the exterior panel 2 has one concave groove 1 like the exterior panel 2*b*, the concave groove 1 is formed at a position which divides the exterior panel 2 into two equal parts in the direction perpendicular to the longitudinal direction of the exterior panel 2, and when the exterior panel 2 has three concave grooves 1 like the exterior panel 2*c*, the concave grooves 1 are formed at positions which divide the exterior panel 2 into four equal parts in the direction perpendicular to the longitudinal direction of the exterior panel 2, and when the exterior panel 2 has n (where n is an integer number) concave grooves 1, the concave grooves 1 are formed at positions which divide the exterior panel 2 into (n+1) equal parts in the direction perpendicular to the longitudinal direction of the exterior panel 2.

Figure 11:
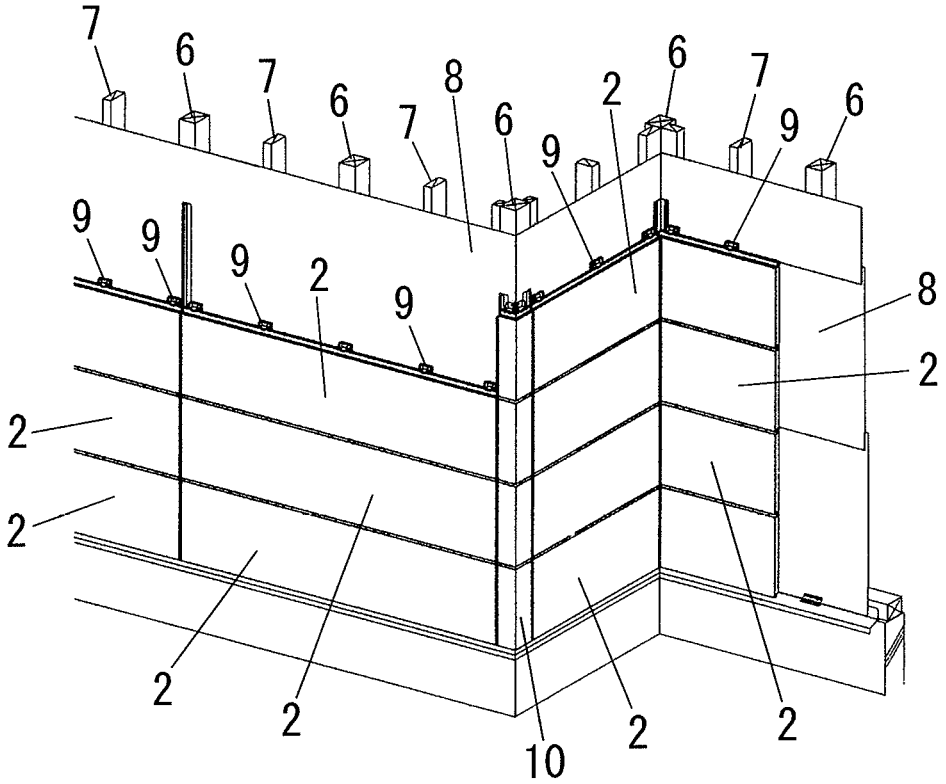
FIG. 11 is a perspective view showing one example of a construction structure of the exterior wall.

The exterior panels 2 formed as above are arranged side by side and connected to each other to form an exterior wall of a house. FIG. 11 shows an example of a construction structure of the exterior wall. Intermediate posts 7 are upwardly provided between posts 6 as a constructional material of a foundation of the exterior wall, and a waterproof paper 8 is papered on outdoor sides of the post 6 and the intermediate posts 7. The plurality of exterior panels 2 are arranged side by side in a matrix on the outside of the waterproof paper 8, and the edges of the exterior panels 2 are fixed to the posts 6 and the intermediate posts 7 by wall fittings 9, whereby the exterior-wall surface is constructed. In FIG. 11, corner exterior panels 10 made of the same material as the exterior panel 2 are disposed at the corner.

In a case where the three kinds of exterior panels 2*a*, 2*b*, and 2*c* of FIG. 1 are used, for example, as shown in FIG. 2A, the exterior panel 2*b*, the exterior panel 2*a*, the exterior panel 2*a*, the exterior panel 2*c*, and the exterior panel 2*c* are arranged in this order from a bottom side in a vertical direction and connected to each other to form the exterior-wall surface. Or, as shown in FIG. 2B, the exterior panel 2*c*, the exterior panel 2*b*, the exterior panel 2*a*, the exterior panel 2*b*, and the exterior panel 2*c* are arranged in this order from a bottom side in a vertical direction and connected to each other.

As shown in FIGS. 2A, and 2B, because each exterior panel 2 has the same outward appearance except the concave groove 1, it is possible to form an outward appearance having a pattern based on the concave groove 1 (and concave groove 1*a*) and having sensation of unity on a whole area of the exterior-wall surface by the concave grooves 1 and the concave grooves 1*a* which are formed by the step-like groove 3 and the adjacent exterior panel 2. Furthermore, because the two or more kinds of exterior panels 2 having a different number of the concave grooves 1 are combined, the arrangement of the concave grooves 1 is less likely to become monotonous repetition, and sparse parts and dense parts are formed in the intervals between the adjacent concave grooves 1, whereby it is possible to form a wall surface which has a varied outward appearance. Furthermore, because the concave grooves 1 are formed at positions which divide the exterior panel 2 at even intervals in the direction perpendicular to the longitudinal direction of the exterior panel 2, the arrangement of the concave grooves 1 does not become irregular and messy, and it is possible to form an outward appearance with sensation of unity while having a variation. By combining two or more kinds of exterior panels 2 arbitrarily and arranging them at arbitrary positions as FIGS. 2A and 2B, it is possible to form exterior-wall surfaces having a wide variety of outward appearances.

Especially, because the concave groove 1 can give a designing change by a shading effect according to a relation between the sunlight and the seeing position, it is possible to increase the variation of the outward appearance of the wall surface. For example, in FIG. 2A, because the intervals between the concave grooves 1 (1*a*) are dense in the upper part of the wall surface, it is possible to give a designing change which emphasizes the shade of the upper part of the wall surface, and in FIG. 2B, because the intervals between the concave grooves 1 (1*a*) are dense in the upper and lower parts of the wall surface, it is possible to give a designing change which emphasizes the shade of the upper and lower parts of the wall surface.

FIG. 3 shows another example in which the three kinds of exterior panels 2*a*, 2*b*, and 2*c* of FIG. 1 are used as the exterior panels 2, and these exterior panels 2 are connected to each other in the horizontal direction as well as in the vertical direction. In a case where two exterior panels having a different number of the concave grooves 1 are connected to each other in the horizontal direction (that is, in a longitudinal direction of the exterior panel), the concave grooves 1 are formed so that all the concave grooves 1 of one exterior panel 2 having a lower number of the concave grooves 1 are communicated with the concave grooves 1 of the other exterior panel 2 having a larger number of the concave grooves 1. If the concave grooves 1 of adjacent exterior panels 2 are not communicated with each other when two exterior panels having a different number of the concave grooves 1 are connected to each other in the longitudinal direction, continuity of the exterior panels is interrupted. But, when the concave grooves 1 are formed so that all the concave grooves 1 of one exterior panel 2 having a lower number of the concave grooves 1 are communicated with the concave grooves 1 of the other exterior panel 2 having a larger number of the concave grooves 1, it is possible to make the concave grooves 1 of the exterior panels having a different number of the concave grooves communicate with each other as much as possible, whereby it is possible to connect the exterior panels 2 so that they become an outward appearance having continuity. Therefore, it becomes easy to form an outward appearance which is natural and has sensation of unity on the whole surface of the exterior-wall surface. Although the exterior panels 2 are directly connected to each other in the longitudinal direction in FIG. 3, the exterior panels 2 may be connected to each other so that a groove is formed between connection ends of the adjacent exterior panels 2.

In a case where the concave grooves 1 are formed at positions which divide the exterior panel 2 at even intervals in the direction perpendicular to the longitudinal direction of the exterior panel 2 as mentioned above, when the exterior panel 2*b* having one concave groove 1 and the exterior panel 2*c* having three concave grooves 1 are connected to each other in the longitudinal direction, it is possible to make the concave grooves 1 of each exterior panel 2 communicate with each other as much as possible. However, if it is not possible to make the concave grooves of each exterior panel 2 communicate with each other, the concave grooves 1 may be formed at positions other than the positions which divide the exterior panel 2 at even intervals in the direction perpendicular to the longitudinal direction of the exterior panel 2.

Figure 4A:
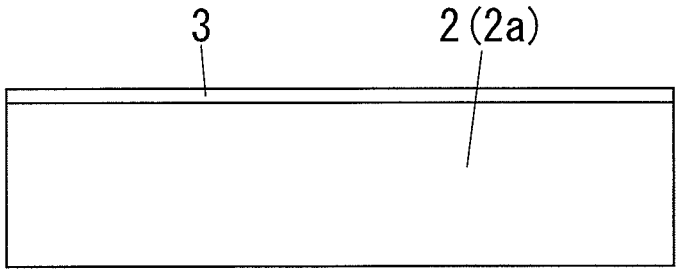
FIG. 4A and FIG. 4B are front views of examples of the exterior panel used in another embodiment of the present invention.
Figure 4B:
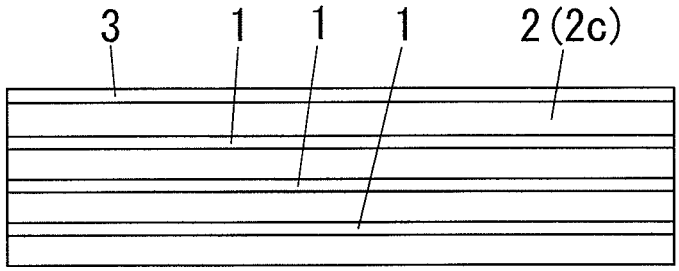

FIGS. 4A, 4B, and 5 show another embodiment of the present invention. In this embodiment, two kinds of the exterior panels 2 of FIGS. 4A and 4B are used. FIG. 4A is a front view of the exterior panel 2*a* which does not have the concave groove 1 (that is, the exterior panel 2*a* having zero concave groove), and FIG. 4B is a front view of the exterior panel 2*c* having three concave grooves 1.

Figure 5B:
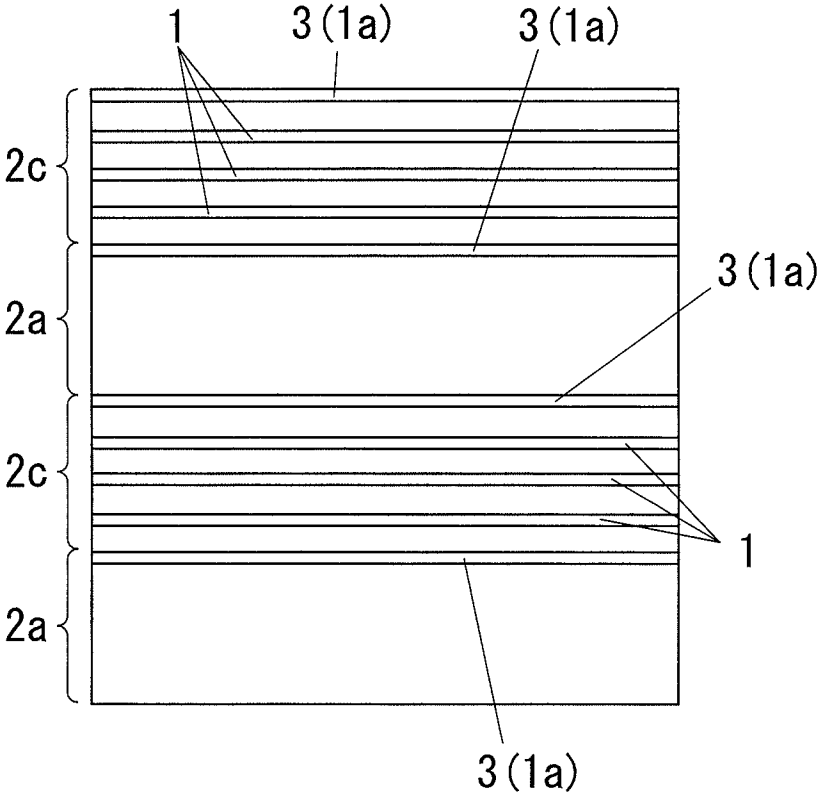
FIGS. 5A and 5B are front views showing examples of the exterior-wall surface formed from the exterior panels of FIGS. 4A and 4B.
Figure 5A:
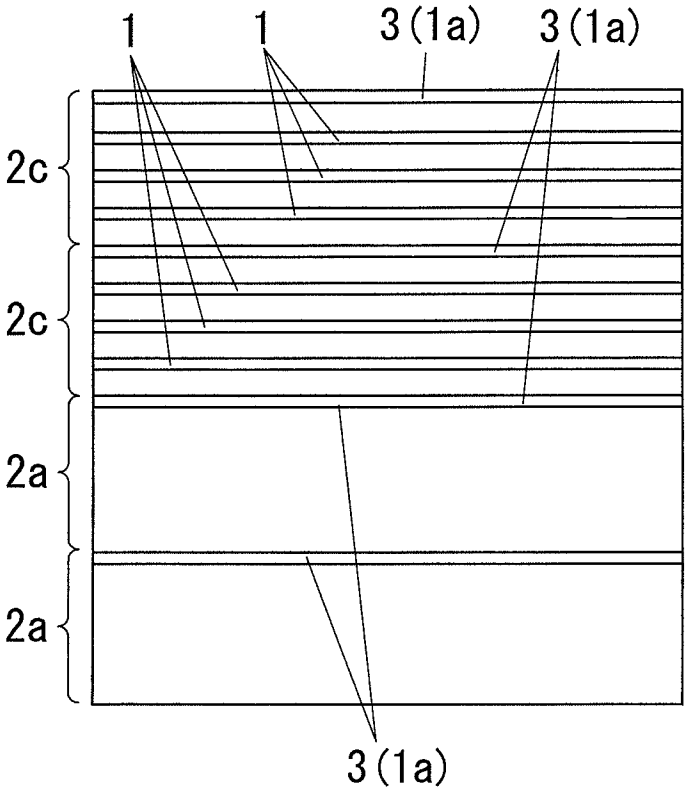

In this embodiment, for example, as shown in FIG. 5A, it is possible to form the exterior-wall surface by arranging the exterior panel 2*a*, the exterior panel 2*a*, the exterior panel 2*c*, and the exterior panel 2*c* in this order from a bottom side in a vertical direction. Or, as shown in FIG. 5B, it is also possible to form the exterior-wall surface by arranging the exterior panel 2*a*, the exterior panel 2*c*, the exterior panel 2*a*, and the exterior panel 2*c* in this order from a bottom side in a vertical direction.

Figure 6:
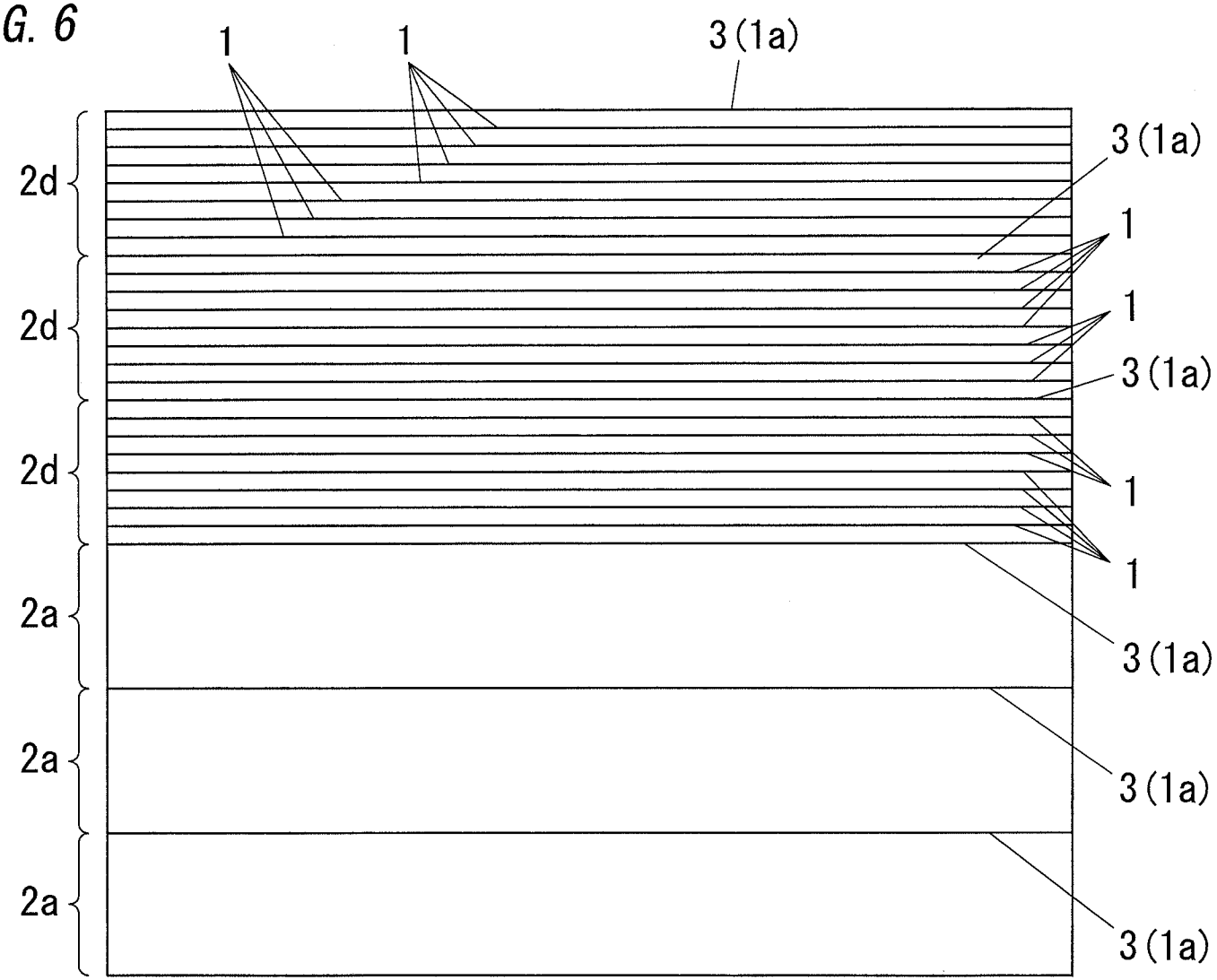
FIG. 6 is a front view showing the exterior-wall surface in another embodiment of the present invention.

FIG. 6 shows another embodiment in which two kinds of exterior panels 2, i.e., the exterior panel 2*a* which does not have the concave groove 1 and an exterior panel 2*d* having seven concave grooves 1, are used. In this embodiment, the exterior-wall surface is formed by arranging three exterior panels 2*a* and three the exterior panels 2*d* in this order from a bottom side in a vertical direction. In this case, because the intervals between the concave grooves 1 are dense in the upper part of the wall surface, it is possible to give a designing change which emphasizes the shade of the upper parts of the wall surface.

Figure 7:
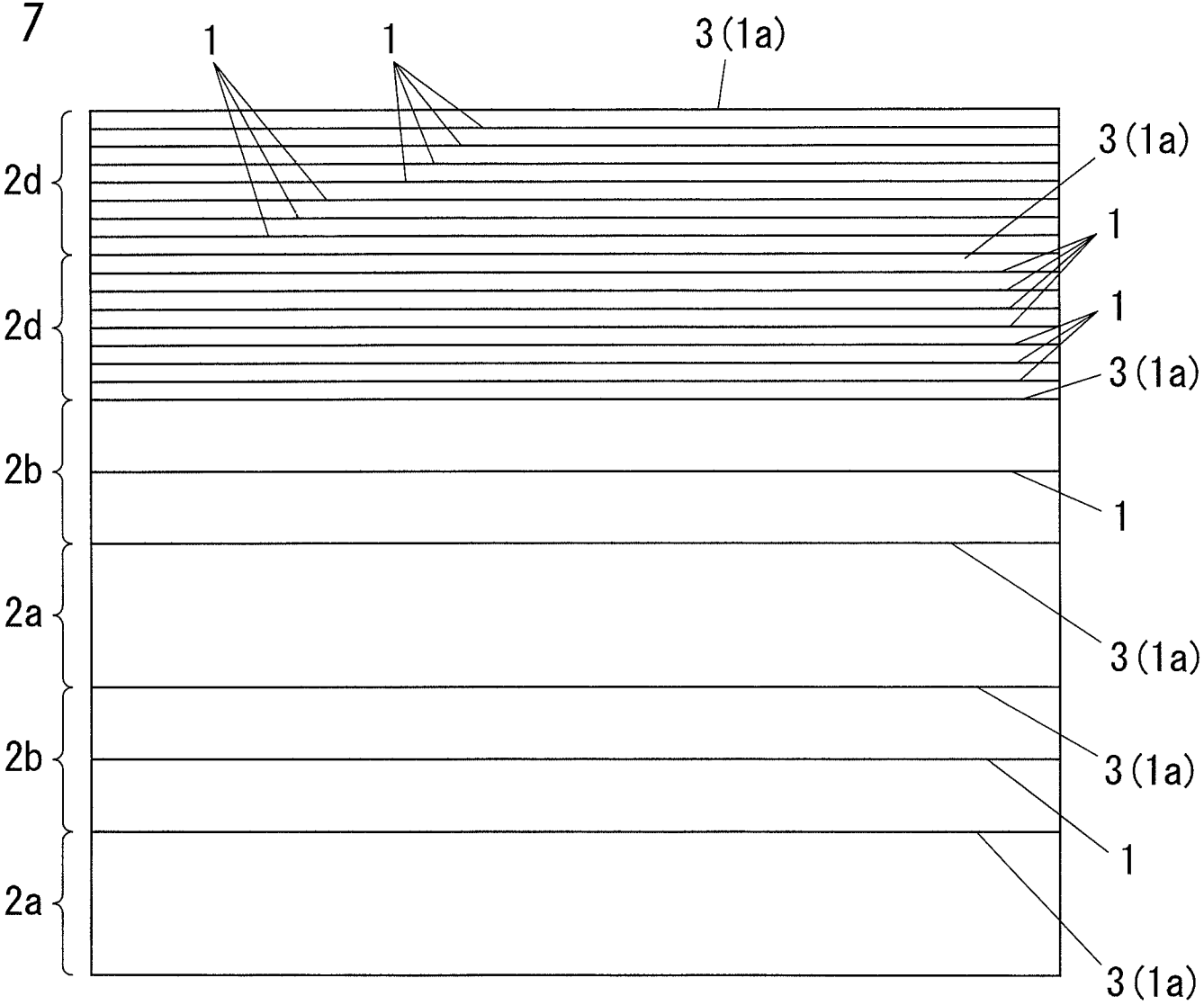
FIG. 7 is a front view showing the exterior-wall surface in another embodiment of the present invention.

FIG. 7 shows another embodiment in which three kinds of the exterior panels 2, i.e., the exterior panel 2*a* which does not have the concave groove 1, the exterior panel 2*b* having one concave groove 1, and the exterior panel 2*d* having seven concave grooves 1, are used. In this embodiment, the exterior-wall surface is formed by arranging the exterior panels 2*a*, the exterior panel 2*b*, the exterior panel 2*a*, the exterior panel 2*b*, the exterior panel 2*d*, and the exterior panel 2*d* in this order from a bottom side in a vertical direction. In this case, it is possible to give a designing change in which the intervals between the concave grooves 1 are dense in the upper part of the wall surface and the intervals between the concave grooves 1 are sparse in the lower part of the wall surface.

Figure 8:
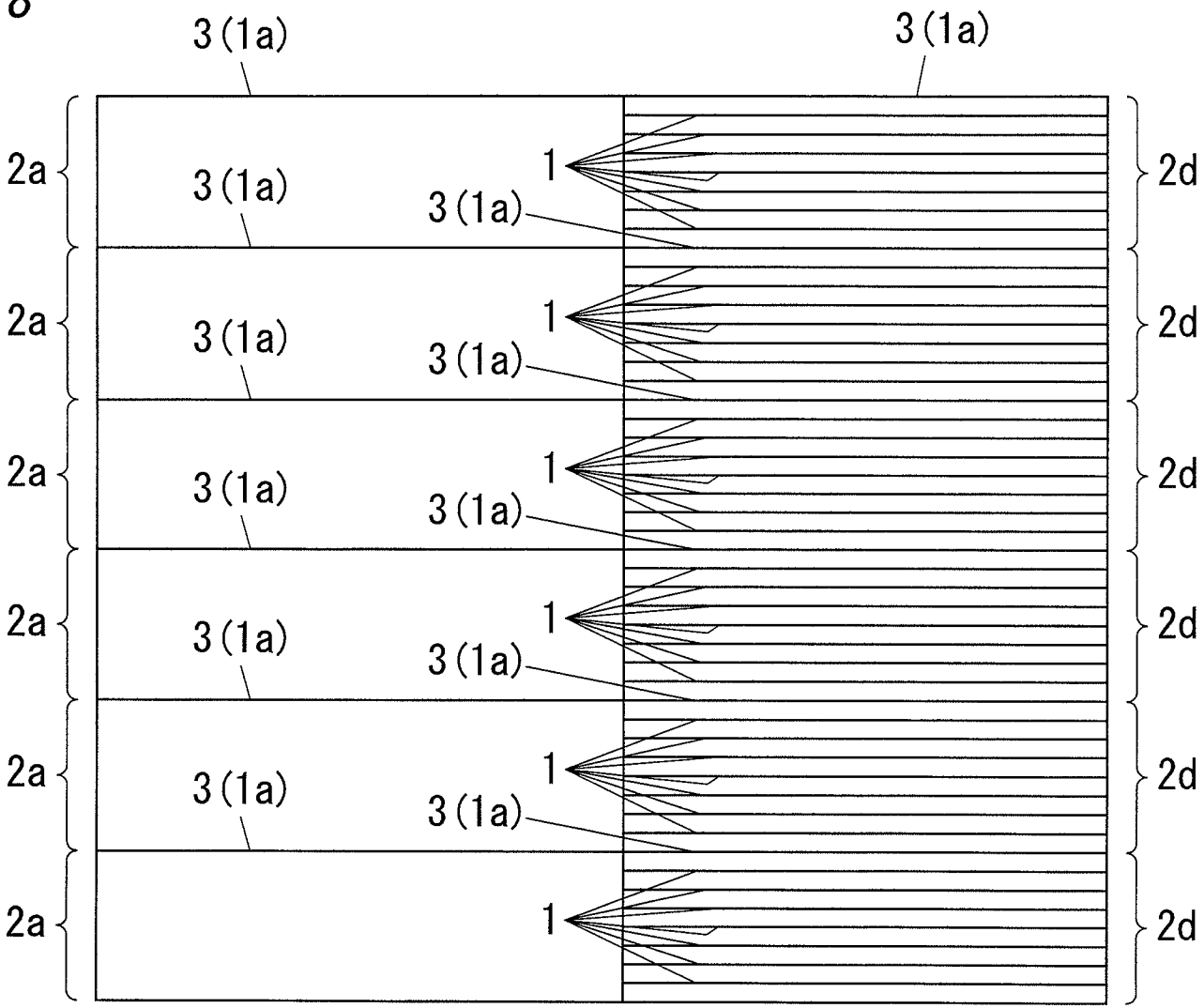
FIG. 8 is a front view showing the exterior-wall surface in another embodiment of the present invention.

FIG. 8 shows another embodiment in which two kinds of the exterior panels 2, i.e., the exterior panel 2*a* which does not have the concave groove 1, and the exterior panel 2*d* having seven concave grooves 1, are used. In this embodiment, the exterior-wall surface is formed by arranging a plurality of exterior panels 2*a* in the vertical direction and connected to each other, and arranging a plurality of exterior panels 2*d* in the vertical direction and connected to each other, and connecting the plurality of exterior panels 2*a* and the plurality of exterior panels 2*d* to each other in the horizontal direction. In this case, it is possible to give a big change in degree of density of the concave groves on the right and left sides of the exterior wall, whereby it is possible to form the wall surface having widely differing images on the right and left sides of the wall surface.

Figure 9A:
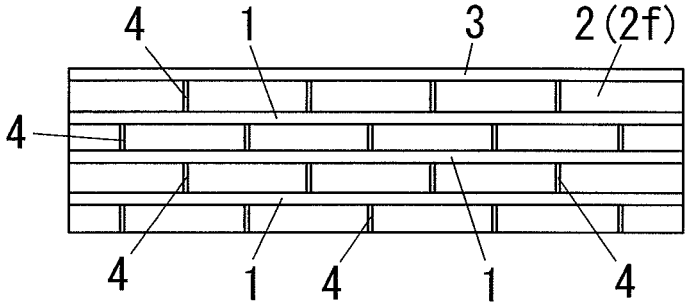
FIG. 9A and FIG. 9B are front views showing examples of the exterior panels used in another embodiment of the present invention.
Figure 9B:
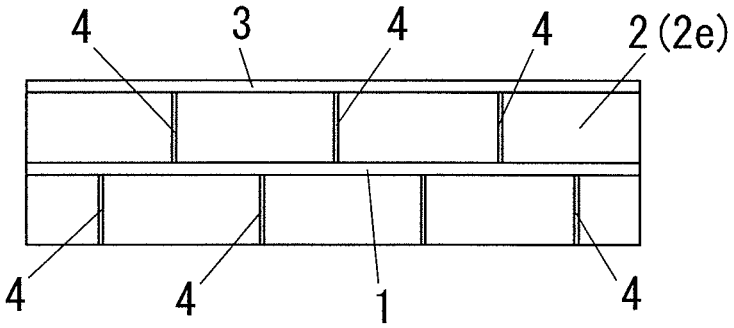

FIGS. 9A, 9B, 10A, and 10B show another embodiment in which exterior panels 2 having a plurality of intersecting grooves 4 which run at right angles with respect to the concave grooves 1 on the surface of the exterior panels 2 are used. As shown in FIGS. 9A and 9B, the intersecting grooves 4 are formed between the adjacent concave grooves 1, and between the concave groove 1 and the step-like groove 3. That is, in this embodiment, the concave grooves 1 are transverse grooves and the intersecting grooves 4 are vertical grooves. The width of the intersecting groove 4 is narrower than that of the concave groove 1.

Figure 10B:
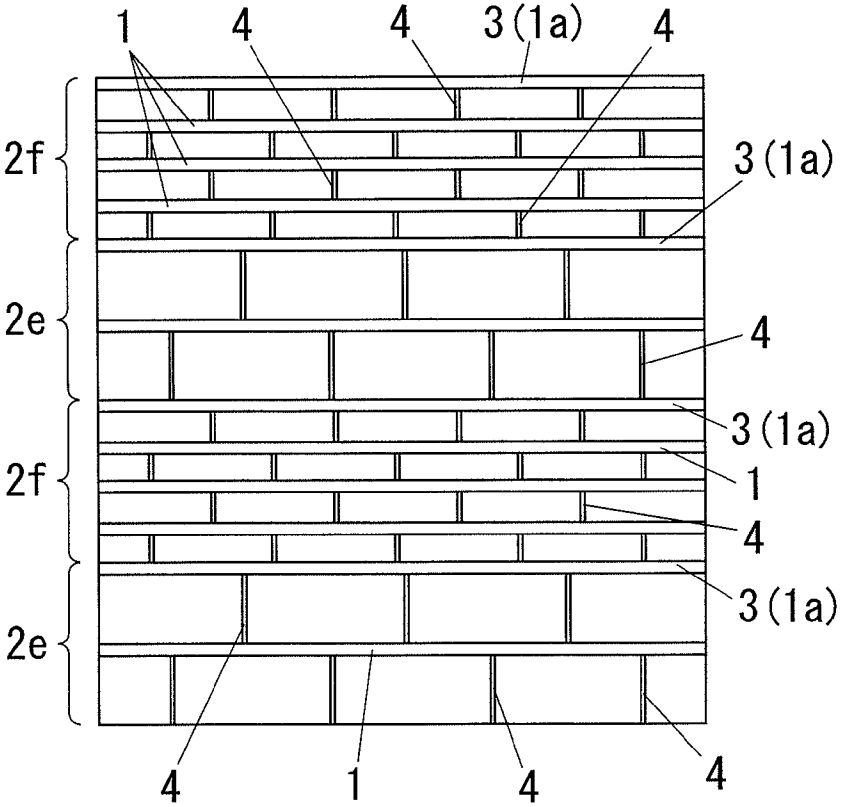
FIG. 10A and FIG. 10B are front views showing examples of the exterior-wall surface formed from the exterior panels of FIGS. 9A and 9B.
Figure 10A:
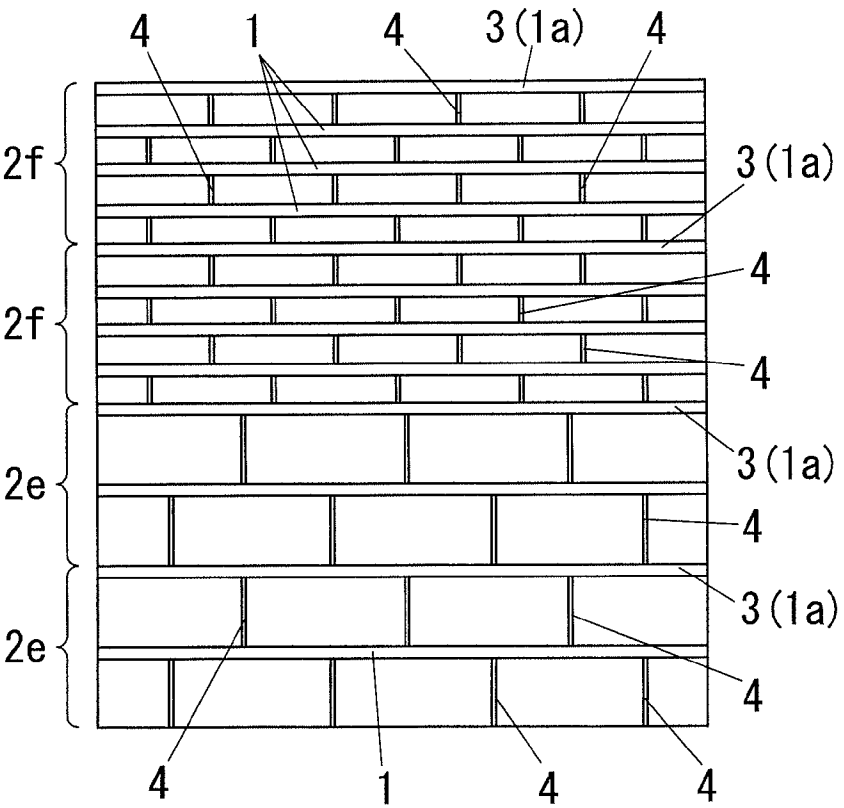

In this embodiment, as shown in FIGS. 9A and 9B, two kinds of the exterior panels 2, i.e., the exterior panel 2*e* having one concave groove 1 and a plurality of intersecting grooves 4, and the exterior panel 2*f* having three concave grooves 1 and a plurality of intersecting grooves 4, are used. By using these exterior panels 2*e* and 2*f*, for example, as shown in FIG. 10A, the exterior-wall surface is formed by arranging the exterior panel 2*e*, the exterior panel 2*e*, the exterior panel 2*f*, and the exterior panel 2*f* in this order from a bottom side in a vertical direction. Or, as shown in FIG. 10B, the exterior-wall surface may be formed by arranging the exterior panel 2*e*, the exterior panel 2*f*, the exterior panel 2*e*, and the exterior panel 2*f* in this order from a bottom side in a vertical direction. In these cases, it is possible to form the exterior-wall surface having a varied outward appearance by the intersecting grooves 4.

The invention claimed is:

1. An exterior-wall structure comprising:

a plurality of exterior panels arranged side by side, wherein the plurality of exterior panels have a uniform outline shape and uniform dimensions, each of the plurality of exterior panels includes a length edge with a step-shaped groove, and an exterior surface, each of the plurality of exterior panels has one or more grooves extending along an entire length in a length direction thereof such that the exterior surface of each exterior panel is divided, by the one or more grooves, into surfaces in a height direction perpendicular to the length direction, in each exterior panel, the surfaces have a uniform size in the height direction, the one or more grooves each have a width in the height direction smaller than the uniform size of the surfaces in the height direction, the plurality of exterior panels includes a first exterior panel and a second exterior panel, a number of grooves of the first exterior panel is greater than a number of grooves of the second exterior panel, the first exterior panel and the second exterior panel are arranged in the height direction perpendicular to the length direction, the plurality of exterior panels includes two exterior panels that are adjacent to each other, each of the two exterior panels including a first length edge as the length edge with the step-shaped groove and a second length edge without the step-shaped groove, and the two exterior panels are combined to provide a second groove defined by the first length edge of the first exterior panel and the second length edge of the second exterior panel facing each other, the second groove having a same width and depth as the one or more grooves.

2. The exterior-wall structure as set forth in claim 1, wherein the plurality of exterior panels have a same surface color.

3. The exterior-wall structure as set forth in claim 1, wherein the plurality of exterior panels include a further exterior panel adjacent to the first exterior panel in the length direction and having a number of grooves smaller than the number of grooves on the first exterior panel, and all of the grooves of the further exterior panel are aligned with the grooves of the first exterior panel.

4. The exterior-wall structure as set forth in claim 1, wherein at least one of the plurality of exterior panels has an intersecting groove which extends at a predetermined angle with respect to the one or more grooves of the at least one of the plurality of exterior panels.

5. The exterior-wall structure as set forth in claim 4, wherein the intersecting groove extends in the height direction perpendicular to the length direction, and extends only a part of a width of the at least one of the plurality of exterior panels.

6. An exterior-wall structure comprising:

a plurality of exterior panels arranged side by side and having a uniform outline shape and uniform dimensions, wherein each of the plurality of exterior panels includes a length edge with a step-shaped groove, and an exterior surface, the plurality of exterior panels includes a first exterior panel, a second exterior panel, and a third exterior panel, the first exterior panel, the second exterior panel, and the third exterior panel are arranged in a height direction so that a length direction of the first exterior panel, a length direction of the second exterior panel, and a length direction of the third exterior panel are parallel to each other and are perpendicular to the height direction, the first exterior panel has a plurality of grooves that extend along an entire length in the length direction thereof in the exterior surface of the first exterior panel such that the exterior surface of the first exterior panel is divided, by the plurality of grooves, into surfaces in the height direction, the surfaces have a uniform size in the height direction, the plurality of grooves each have a width in the height direction smaller than the uniform size of the surfaces in the height direction, the second exterior panel has no groove that extends along an entire length in the length direction thereof in the exterior surface of the second exterior panel, the third exterior panel has one groove that extends along an entire length in the length direction thereof in the exterior surface of the third exterior panel such that the exterior surface of the third exterior panel is divided, by the one groove, into two surfaces in the height direction, the two surfaces have a uniform size in the height direction, the one groove has a width in the height direction smaller than the uniform size of the two surfaces in the height direction, the plurality of exterior panels includes two exterior panels that are adjacent to each other, each of the two exterior panels including a first length edge as the length edge with the step-shaped groove and a second length edge without the step-shaped groove, and the two exterior panels are combined to provide a second groove defined by the first length edge of the first exterior panel and the second length edge of the second exterior panel facing each other, the second groove having a same width and depth as the plurality of grooves and the one groove.

7. An exterior-wall structure comprising:

a plurality of exterior panels arranged side by side and having a uniform outline shape and uniform dimensions, wherein each of the plurality of exterior panels includes a length edge with a step-shaped groove, and an exterior surface, the plurality of exterior panels includes a first exterior panel and a second exterior panel, the first exterior panel and the second exterior panel are arranged in a height direction so that a length direction of the first exterior panel and a length direction of the second exterior panel are parallel to each other and are perpendicular to the height direction, the first exterior panel has a plurality of grooves that extend along an entire length in the length direction thereof in the exterior surface of the first exterior panel such that the exterior surface of the first exterior panel is divided, by the plurality of grooves, into surfaces in the height direction, the surfaces have a uniform size in the height direction, the plurality of grooves each have a width in the height direction smaller than the uniform size of the surfaces in the height direction, the second exterior panel has no groove that extends along an entire length in the length direction the exterior surface thereof in the second exterior panel, the plurality of exterior panels includes two exterior panels that are adjacent to each other, each of the two exterior panels including a first length edge as the length edge with the step-shaped groove and a second length edge without the step-shaped groove, and the two exterior panels are combined to provide a second groove defined by the first length edge of the first exterior panel and the second length edge of the second exterior panel facing each other, the second groove having a same width and depth as the plurality of grooves.

* * * * *